US005115220A

United States Patent [19]

Suuronen et al.

[11] Patent Number: 5,115,220

[45] Date of Patent: May 19, 1992

[54] FUSE WITH THIN FILM FUSIBLE ELEMENT SUPPORTED ON A SUBSTRATE

[75] Inventors: David E. Suuronen, Newburyport; Jean C. Terry, Amesbury, both of Mass.

[73] Assignee: Gould, Inc., Eastlake, Ohio

[21] Appl. No.: 637,161

[22] Filed: Jan. 3, 1991

[51] Int. Cl.[5] ..... H01H 85/04; H01H 71/20

[52] U.S. Cl. ..... 337/297; 337/152; 361/395

[58] Field of Search ..... 337/297, 151, 152, 153; 361/402, 403, 395; 357/51

[56] References Cited

U.S. PATENT DOCUMENTS

| | | | |
|---|---|---|---|
| 1,062,889 | 5/1913 | Clemens . | |
| 2,263,752 | 11/1941 | Babler | 337/297 |
| 2,288,428 | 6/1942 | Babler | 337/297 |
| 3,271,544 | 9/1966 | Ragan . | |
| 4,140,988 | 2/1979 | Oakes . | |
| 4,208,645 | 6/1980 | Harmon et al. . | |
| 4,376,927 | 3/1983 | McGalliard . | |
| 4,494,104 | 1/1985 | Holmes . | |
| 4,520,338 | 5/1985 | Watanabe . | |
| 4,749,980 | 6/1988 | Morrill, Jr. et al. . | |
| 4,823,235 | 4/1989 | Suzuki et al. | 361/395 |
| 4,873,506 | 10/1989 | Gurevich . | |
| 4,926,543 | 5/1990 | Morrill, Jr. et al. . | |

*Primary Examiner*—Harold Broome
*Attorney, Agent, or Firm*—Fish & Richardson

[57] ABSTRACT

A fuse including a fuse casing, an end cap terminal at an end of the casing, a substrate supporting a thin film fusible element thereon, and a springy metal connecting strip made of sheet metal and providing electrical connection between the element and the terminal and mechanical support for the substrate.

12 Claims, 1 Drawing Sheet

FUSE WITH THIN FILM FUSIBLE ELEMENT SUPPORTED ON A SUBSTRATE

BACKGROUND OF THE INVENTION

The invention relates to thin film fusible elements that are supported on substrates and their use in electrical fuses.

It is known to provide fusible elements from thin films of conductive material supported on insulating substrates. This permits an element thickness that is less than that achievable by stamping (i.e., 0.002") in order to provide low-current capacity and ease of handling during manufacture. Examples of patents describing fusible elements having thin films of conductive material on substrates provided by various deposition techniques are: U.S. Pat. Nos. 3,271,544; 4,140,988; 4,208,645; 4,376,927; 4,494,104; 4,520,338; 4,749,980; 4,873,506; and 4,926,543.

SUMMARY OF THE INVENTION

In general, the invention features a fuse made of a fuse casing, an end cap terminal at an end of the casing, a substrate supporting a thin film fusible element thereon inside the fuse casing, and a springy metal connecting strip made of sheet metal and providing electrical connection between the fusible element and the terminal and mechanical support for the substrate.

In preferred embodiments, there are end cap terminals at both ends of the fuse casing and springy metal connecting strips connecting the substrate at both ends. The substrate is shorter than the distance between facing surfaces of the end cap terminals and is made of rigid material (most preferably ceramic). The springy metal strip engages the substrate on both sides of the substrate and has two end portions engaging two edges of the fuse casing. The strip is soldered to the substrate at a conductive portion of the fusible element thereon. The strip extends from an end of the fuse casing generally toward the other end of the casing for one distance and then reverses direction and extends for a shorter distance to the end of the substrate. The portion of the strip extending toward the other end is at an angle to the substrate and is connected to the portion going in the reverse direction by a third portion that is generally perpendicular to the substrate surface. The fuse may include fiber washers between the end terminals and the connecting strips. The fuse casing includes arc-quenching fill material. The thin film fusible element is deposited, most preferably by DC magnetron sputtering, although other deposition processes could be used also.

Other advantages and features of the invention will be apparent from the following description of a preferred embodiment thereof and from the claims.

DESCRIPTION OF THE PREFERRED EMBODIMENT

The preferred embodiment will now be described.

DRAWINGS

STRUCTURE, MANUFACTURE AND USE

Figure 1:
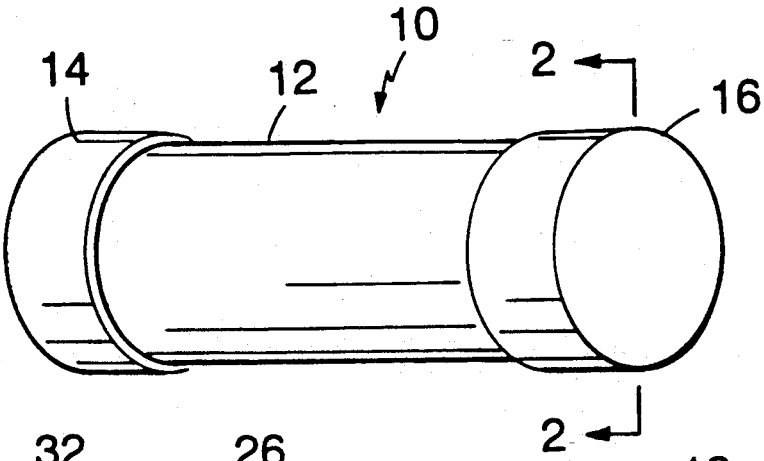
FIG. 1 is a perspective view of a fuse according to the invention.

Referring to FIG. 1, there is shown fuse 10 having cylindrical fuse casing 12 and end cap terminals 14, 16 at the ends of fuse casing 12.

Figure 2:
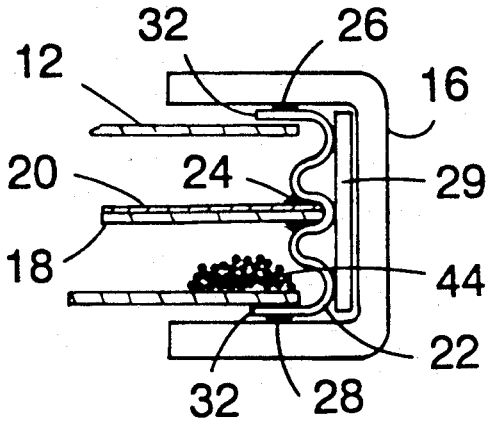
FIG. 2 is a partial, vertical sectional view, taken at 2—2 of FIG. 1, of the FIG. 1 fuse.

Referring to FIG. 2, it is seen that within fuse casing 12, there is substrate 18 having thin film fusible element 20 deposited thereon. Springy metal connecting strip 22 is made of sheet metal and provides electrical connection between fusible element 20 and end cap terminal 16 and mechanical support for substrate 18 within fuse casing 12. Strip 22 is electrically connected to fusible element 20 and physically connected to substrate 18 via solder 24. Solder masses 26, 28 make electrical connection between the end portions of strip 22 and end cap terminal 16. Fiber washer 29 is between strip 22 and an inner surface of end cap terminal 16.

Figure 3:
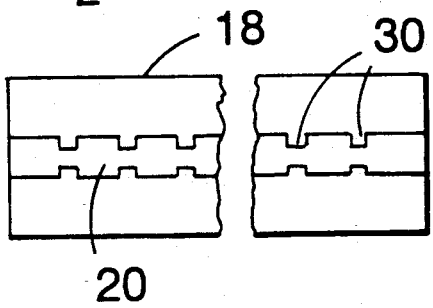
FIG. 3 is a plan view of a substrate that supports a thin film fusible element and is used in the FIG. 1 fuse.

Referring to FIG. 3, it is seen that fusible element 20 has a plurality of notch sections 30 along its length. Fusible element 20 is preferably deposited by D.C. magnetron sputtering and is less than 0.001" thick, the actual thickness depending upon the current rating of the fuse. E.g., copper approximately 70 microinches thick would be used for a one amp fuse.

Figure 4:
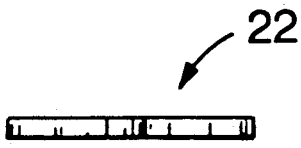
FIG. 4 is a plan view of a springy metal connecting strip of the FIG. 1 fuse.
Figure 5:
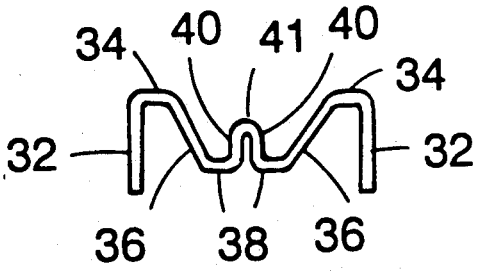
FIG. 5 is an elevation of the FIG. 4 strip.

Referring to FIGS. 4 and 5, springy metal connecting strip 22 has end portions 32 (0.265" long) that are received between the outside of fuse casing 12 and the inside of end cap terminal 16; radial portions 34 that sit at the end of fuse casing 12 (0.070" long); angled portions 36 (0.230" long), central radial portions 38 (0.050" long); axial central portions 40 (0.125" long) and radial central portion 41 (0.020" long). Two portions 40 and portion 41 wrap around and engage an end of substrate 18, which is 0.020" thick. Strip 22 is made of copper and is 0.0025" thick and 0.062" wide. The material and the thickness and width of strip 22 were selected so that the resistance of the material does not significantly affect the performance of the fuse and to provide the desired spring characteristics. Substrate 18 is preferably made of $Al_2O_3$, although other substrate material can be used also.

In manufacture, both strips 22 are bent to provide the bends between portions 38, 40 and 41 as shown in FIG. 5 and to have right angles between portions 38 and straight end portions that are later bent to provide portions 36, 34, 32. Both strips 22 are then soldered to fusible element 20 using solder mass 24 at each end of substrate 18, and substrate 18 is placed within fuse casing !2. One strip 22 is bent around the end of casing 12, providing portions 36, 34, 32 and the bends between them shown in FIG. 5 along with the obtuse angle between portions 38 and 36. Solder paste 26, 28 is applied on end portions 32, and end terminal 14 is pressed onto the end of fuse casing 12. Solder paste 26, 28 is then melted by heating on a hot plate. Fuse casing 12 is then filled with arc-quenching fill material 44 (e.g., 50/70 quartz). The other end cap terminal 16 is then added in a similar manner to complete the manufacture of fuse 10.

Substrate 18 is shorter in length than the distance between the interior facing surfaces of end caps 14, 16, and strips 22 each tend to bias substrate 18 toward the center. This guarantees that the ends of rigid substrate 18 will not be compressed by end cap terminals 14, 16 and damaged during manufacture and use, including use with temperature cycling and differential thermal expansion of different materials. The metal strips act as shock absorbers and tend to avoid damage to the fuse and provide vibration isolation for substrate 18. The preferred design also provides for the attachment to multiple thin film elements deposited on either side of the substrate.

OTHER EMBODIMENTS

Figure 6:
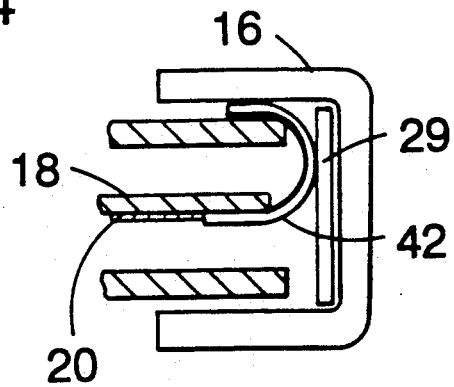
FIG. 6 is a partial, vertical sectional view, similar to FIG. 2, of an alternative embodiment.

Other embodiments of the invention are within the scope of the following claims. For example, as shown in FIG. 6, metal strip 42 can be used to connect the substrate to only one side of the fuse casing, particularly, where the dimensions of the fuse casing are very small (e.g. a 1¼" long and ¼" diameter fuse casing). In addition, the metal strip might only be used at one end of a substrate. Also other springy materials might be used for strip 22 (e.g., brass and beryllium materials), and the strips might be welded to the thin film element.

What is claimed is:

1. A fuse comprising a fuse casing, an end cap terminal at an end of said casing, a substrate supporting a thin film fusible element thereon and located within said casing, and a springy metal connecting strip made of sheet metal and providing electrical connection between said element and said terminal and mechanical support for said substrate, said substrate having an end spaced from said end cap terminal, said connecting strip biasing said substrate away from said end cap terminal.

2. The fuse of claim 1 further comprising another end cap terminal at another end of said casing and a second springy metal connecting strip made of sheet metal and providing electrical connection between said element and said another end cap terminal and additional mechanical support for said substrate, said substrate having a length that is less than the distance between said end cap terminals.

3. A fuse comprising a fuse casing, an end cap terminal at an end of said casing, a substrate supporting a thin film fusible element thereon and located within said casing, and a springy metal connecting strip made of sheet metal and providing electrical connection between said element and said terminal and mechanical support for said substrate, wherein said connecting strip engages said substrate on two surfaces thereof and has two end portions that engage opposite sides of said fuse casing.

4. The fuse of claim 1 wherein said substrate is made of a rigid material.

5. The fuse of claim 4 wherein said substrate is made of ceramic material.

6. The fuse of claim 3 further comprising solder used to connect said connecting strip to said substrate.

7. A fuse comprising a fuse casing, an end cap terminal at an end of said casing, a substrate supporting a thin film fusible element thereon and located within said casing, and a springy metal connecting strip made of sheet metal and providing electrical connection between said element and said terminal and mechanical support for said substrate, wherein the said connecting strip includes a first portion that extends from an end of said fuse casing toward the other end a first distance and a second portion that is connected to the first and extends in the reverse direction to the end of the substrate a second distance which is shorter than the first distance so as to tend to position said substrate away from said end cap terminal.

8. The fuse of claim 7 wherein said first portion makes an acute angle with a surface of the substrate, and said strip has a third portion that connects said first portion to said second portion and is substantially perpendicular to the substrate.

9. The fuse of claim 2 further comprising a fiber washer between said connecting strip and an inner surface of said end cap terminal.

10. The fuse of claim 1 further comprising arcquenching material substantially filling said fuse casing.

11. The fuse of claim 1 wherein said fusible element has been deposited.

12. The fuse of claim 2 wherein said fuse casing is cylindrical, and said substrate is rectangular.

* * * * *